US008316887B2

(12) United States Patent
Lin

(10) Patent No.: US 8,316,887 B2
(45) Date of Patent: Nov. 27, 2012

(54) WATER TAP

(76) Inventor: Chen-Chang Lin, Shengang Township, Taichung County (TW)

( * ) Notice: Subject to any disclaimer, the term of this patent is extended or adjusted under 35 U.S.C. 154(b) by 239 days.

(21) Appl. No.: 12/853,379

(22) Filed: Aug. 10, 2010

(65) Prior Publication Data

US 2012/0037249 A1 Feb. 16, 2012

(51) Int. Cl.
*F16K 27/00* (2006.01)
*E03C 1/04* (2006.01)

(52) U.S. Cl. ..... 137/601.18; D23/255; 4/678; 137/801

(58) Field of Classification Search ..... 137/801, 137/601.18, 603; 4/661, 675, 678, 676, 677; D23/238–240, 255; 239/17, 24, 25, 589, 239/590.5, 504
See application file for complete search history.

(56) References Cited

U.S. PATENT DOCUMENTS

D25,415 S * 4/1896 Hotchkiss ..... D23/255
D69,421 S * 2/1926 Wuesthoff ..... D23/255
1,728,492 A * 9/1929 Kaufman ..... 4/695
D94,760 S * 3/1935 Hitchcock ..... D23/240
D319,293 S * 8/1991 Rosenbaum ..... D23/238
D432,833 S * 10/2000 Gastelum et al. ..... D6/531
D568,442 S * 5/2008 Garner ..... D23/238
D583,904 S * 12/2008 Oh ..... D23/238
D583,905 S * 12/2008 Oh ..... D23/238
2009/0183307 A1* 7/2009 Cutts ..... 4/614

FOREIGN PATENT DOCUMENTS

JP 2000064376 * 2/1999

* cited by examiner

*Primary Examiner* — Stephen M Hepperle
*Assistant Examiner* — Kevin Barss
(74) *Attorney, Agent, or Firm* — Hershkovitz & Associates, LLC; Abraham Hershkovitz

(57) ABSTRACT

The water tap has a tap stand, an outlet section and a storage frame. The tap stand is hollow and has a bottom end, an inlet and a flowing channel. The inlet is formed through the bottom end of the tap stand. The flowing channel is formed through the tap stand and communicating with the inlet of the tap stand. The outlet section is mounted on the tap stand and has an outfall communicating with the flowing channels. The storage frame is mounted on the tap stand and has a storage plank and a storage hole to hold the a rinsing cup or put on the other toiletries like a toothpaste, a toothbrush or a hand washing cream in order to keep the sink clean and use convenient.

14 Claims, 6 Drawing Sheets

WATER TAP

BACKGROUND OF THE INVENTION

1. Field of the Invention

The present invention relates to a water tap, and more particularly to a water tap with a storage frame to provide a storage function and keep a sink neat.

2. Description of Related Art

A convention water tap is set on a sink and communicated to the water pipe of the water supply and provides functions of controlling the release of the water and adjusting the flow rate of the water. The water tap is generally set on the sink in a restroom or a kitchen. Many toiletries like a rinsing cup, a toothpaste, a toothbrush or a hand washing cream are randomly put on the sink near the water tap in order to use conveniently.

However, because the convention water tap does not have any storage function, and the toiletries are put randomly on the sink near the water tap is not neat and may be overturned or dropped down and stain the ground of the restroom or kitchen.

To overcome the shortcomings, the present invention tends to provide a water tap to mitigate or obviate the aforementioned problems.

SUMMARY OF THE INVENTION

The main objective of the present invention is to provide a water tap with a storage frame to provide a storage function and keep a sink clean.

The water tap has a tap stand, an outlet section and a storage frame. The tap stand is hollow and has a bottom end, a top end, an inlet and a flowing channel. The inlet is formed through the bottom end of the tap stand. The flowing channel is formed through the tap stand and communicating with the inlet of the tap stand. The outlet section is mounted on the tap stand and has an outfall communicating with the flowing channels. The storage frame is mounted on the tap stand and has a storage plank and a storage hole to hold the a rinsing cup or put on the other toiletries like a toothpaste, a toothbrush or a hand washing cream in order to keep the sink clean and use convenient.

Other objects, advantages and novel features of the invention will become more apparent from the following detailed description when taken in junction with the accompanying drawings.

DETAILED DESCRIPTION OF PREFERRED EMBODIMENT

Figure 1:
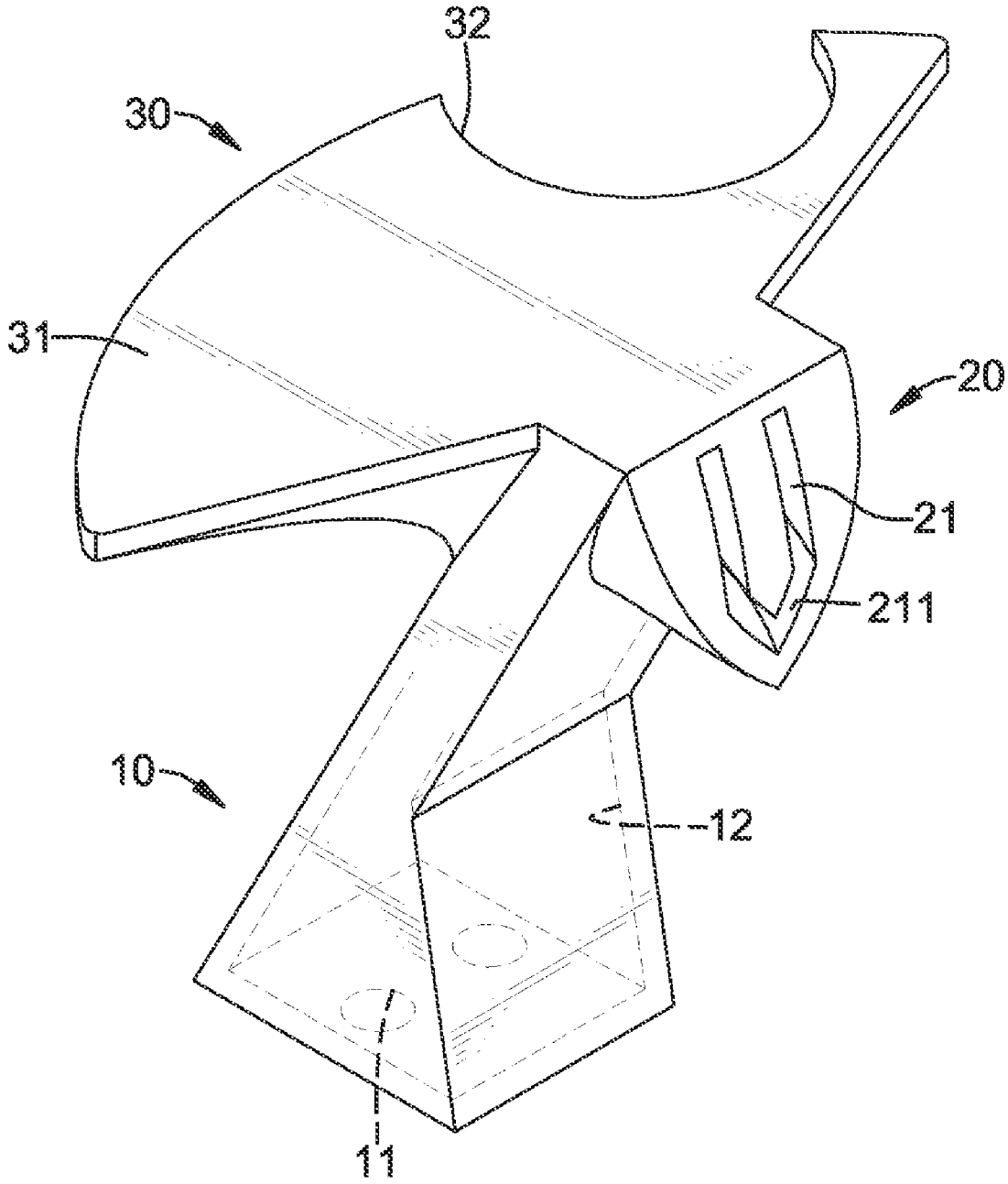
FIG. 1 is a perspective view of a water tap in accordance with the present invention.
Figure 2:
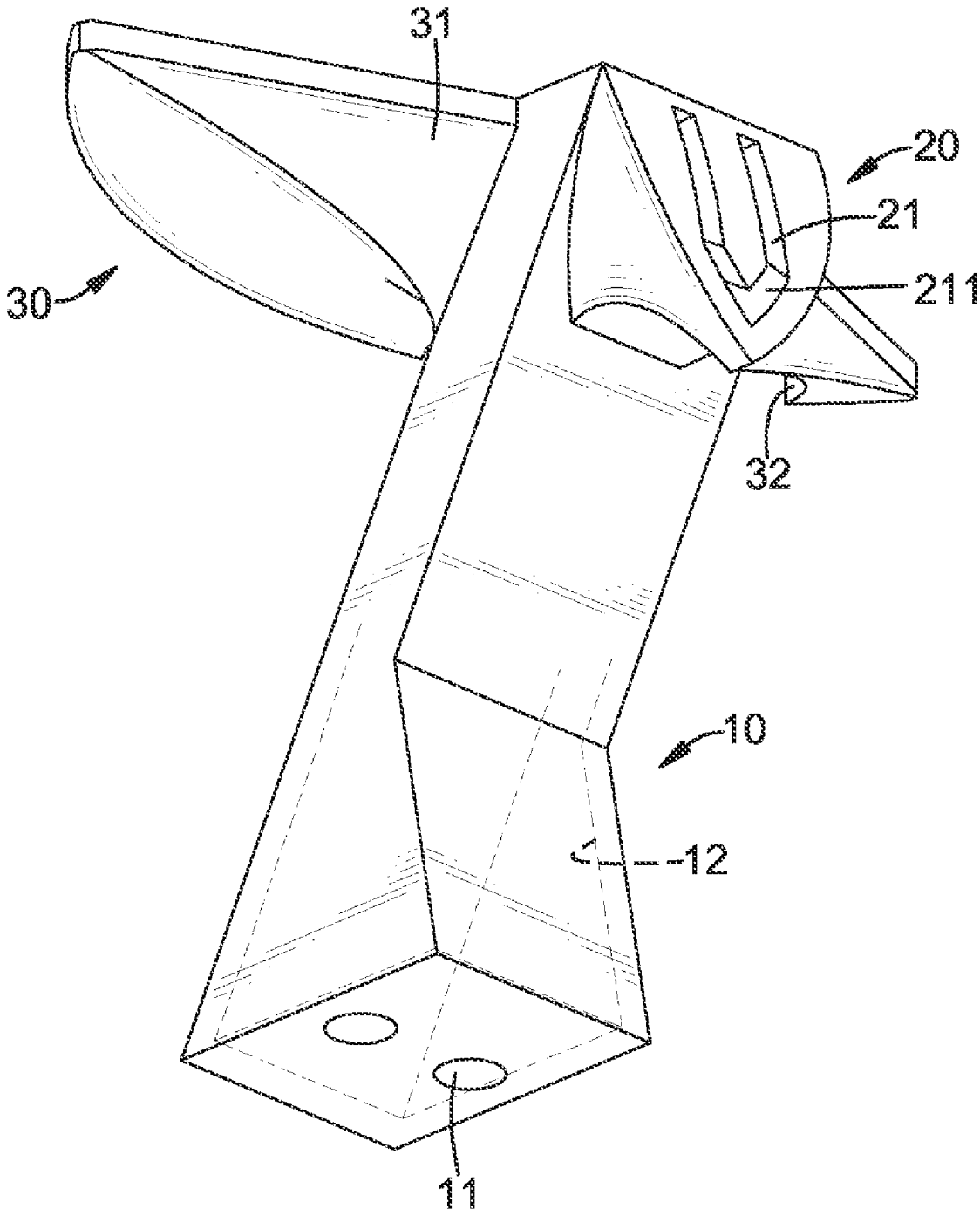
FIG. 2 is another perspective view of the water tap in FIG. 1.
Figure 3:
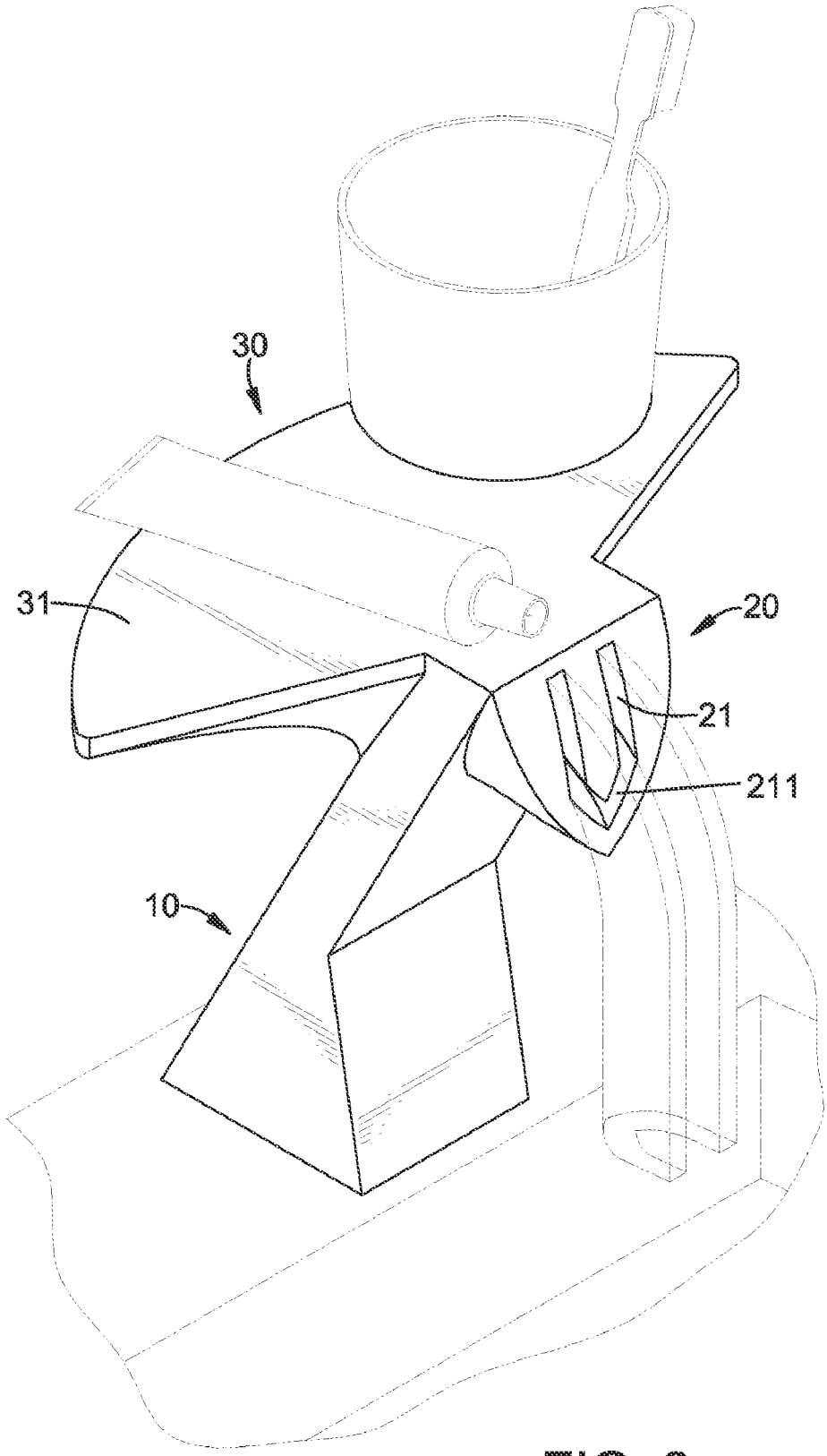
FIG. 3 is an operational perspective view of the water tap in FIG. 1 showing a using condition of the water tap.

With reference to FIGS. 1 to 6, a water tap in accordance with the present invention has a tap stand 10, an outlet section 20 and a storage frame 30. The tap stand 10 is hollow and has a bottom end, a top end, an inlet 11 and a flowing channel 12. The inlet 11 is formed through the bottom end of the tap stand 10 and may comprise a pair of circle holes or multiple circle holes. The flowing channel 12 is formed through the tap stand 10 from the bottom end to the top end and communicates with the inlet 11 of the tap stand 10.

The outlet section 20 is mounted on the top end of the tap stand 10 and has a flat top and two outfalls 21, 21A and may have different types as below. In the first type, with reference to FIGS. 1 to 3, the outlet section 20 has an inclined surface, two outfalls 21 and a connecting outfall 211. The outfalls 21 and the connecting outfall 211 are formed through the inclined surface of the outlet section 20 and communicates with the flowing channel 12. The outfalls 21 are formed separately and are elongated to include long sides. The directions of the long sides of the outfalls 21 are not collinear. The connecting outfall 211 communicates with the outfalls 21. The connecting outfall 211 and the outfalls 21 jointly present a V-shaped cross section.

Figure 4:
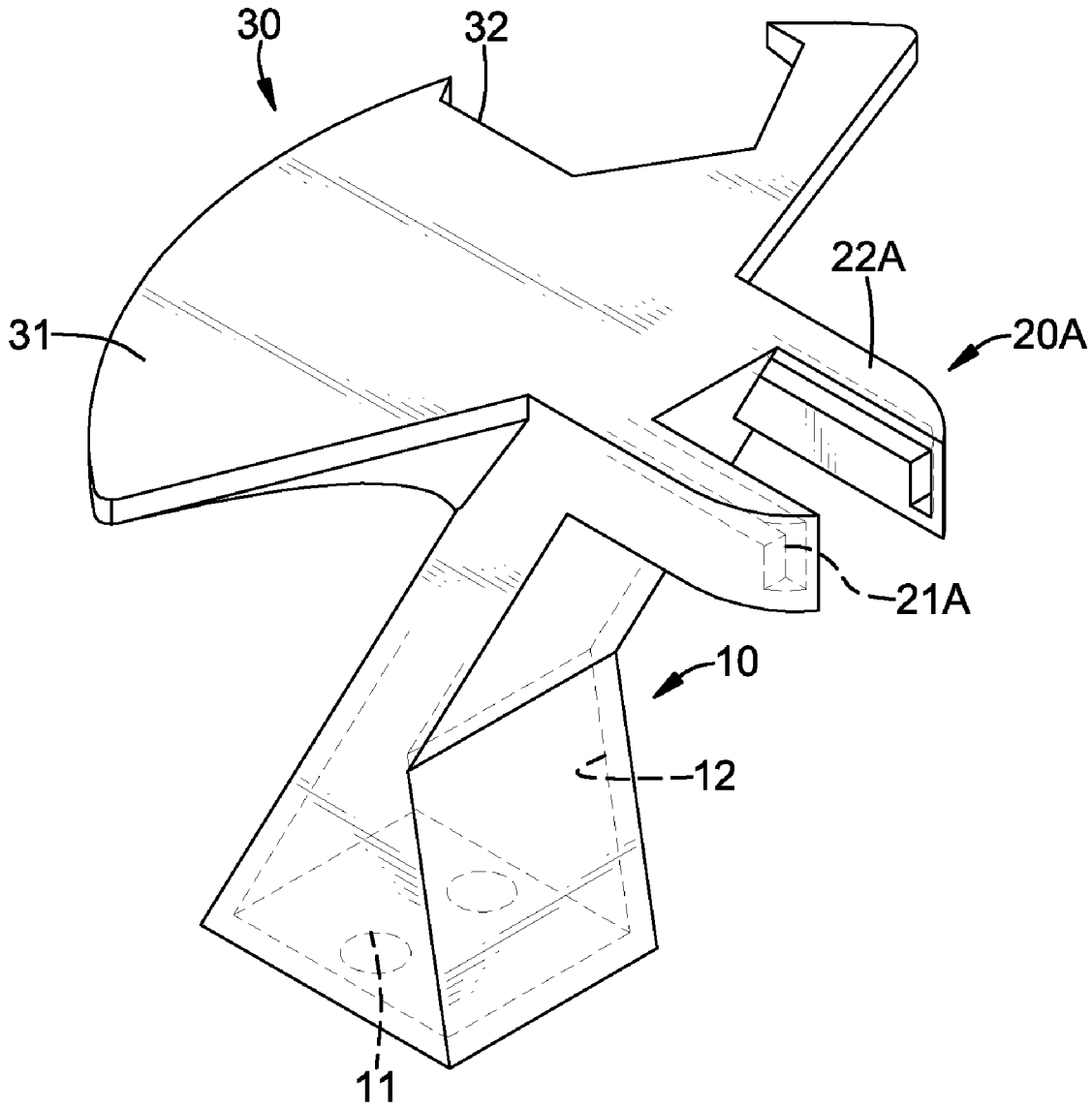
FIG. 4 is a perspective view of another embodiment of a water tap in accordance with the present invention.
Figure 5:
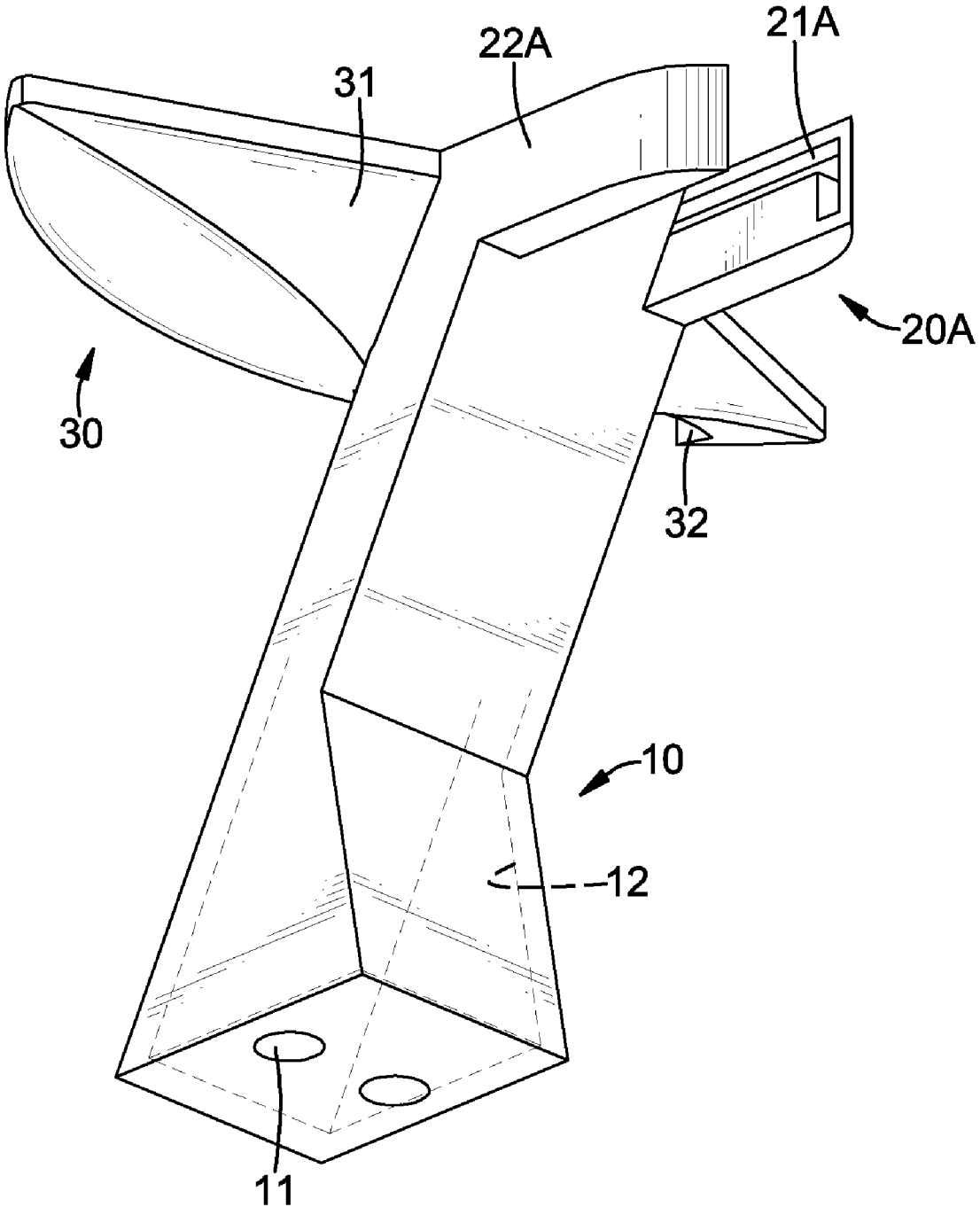
FIG. 5 is another perspective view of the water tap in FIG. 4.
Figure 6:
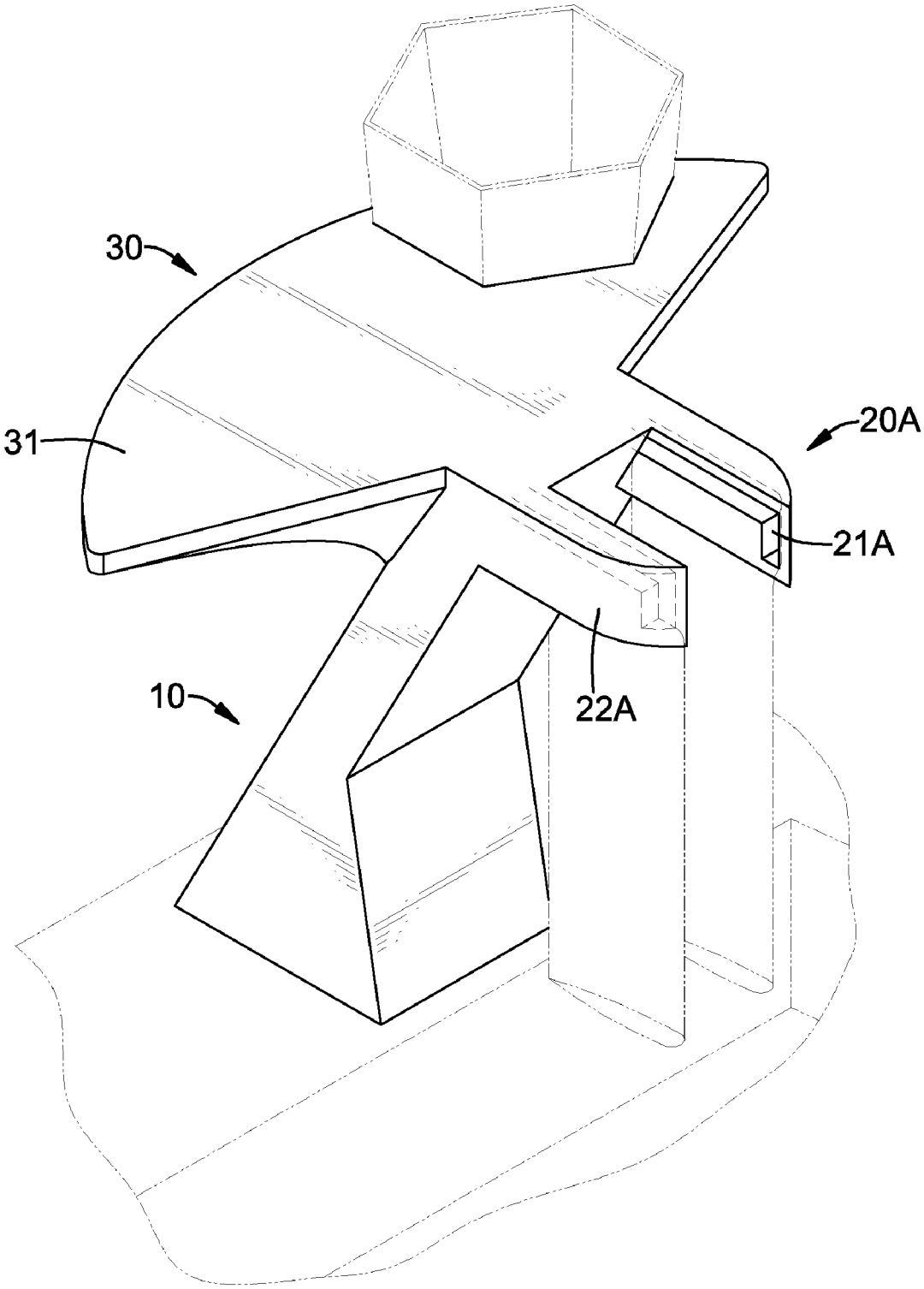
FIG. 6 is an operational perspective view of the water tap in FIG. 4 showing a using condition of the water tap.

In the second type, with reference to FIGS. 4 to 6, the outlet section 20A has two arms 22A and two outfalls 21A. The arms 22A protrude from and are mounted on the top end of the tap stand 10 and are parallel to each other. The arms 22A respectively have an inner surface facing to each other. The two outfalls 21A are respectively formed through the inner surfaces of the arms 22A of the outlet section 20 and communicate with the flowing channel 12 of the tap stand 10A. Each outfall 22A may have a L-shaped cross section.

The storage frame 30 is mounted on the top end of the tap stand 10 opposite to the outlet section 20 and has a storage plank 31 and a storage hole 32. The storage plank 31 is sectorial and has a flat surface and a curved edge. The flat surface of the storage plank 31 is at the same horizontal level with the flat top of the outlet section 20, 20A. The storage hole 32 is formed through the storage plank 31 and is depressed from the curved edge of the storage plank 31. The storage hole 32 may be semicircle or polygon to fit with and hold a rinsing cup with different shapes.

In use, the rinsing cup is mounted in the storage hole 32 and held by the storage plank 31 of the storage frame 30. The other toiletries like a toothpaste, a toothbrush or a hand washing cream may be put in the rinsing cup or put on the storage plank 31 to prevent from dropping down and staining the ground of the restroom or kitchen and to keep the sink clean.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A water tap comprising:

a tap stand being hollow and having:

a bottom end;

a top end;

an inlet formed through the bottom end of the tap stand;

a flowing channel formed through the tap stand and communicating with the inlet of the tap stand;

an outlet section mounted on the tap stand and having two outfalls formed separately, being elongated to include long sides and communicating with the flowing channel; wherein the long sides of the outfalls are not collinear in direction; and a storage frame mounted on the tap stand and having a storage plank and a storage hole defined in the storage plank.

2. The water tap as claimed in claim 1, wherein the outlet section has a flat top;

the storage plank has a flat surface being at a same horizontal level with the flat top of the outlet section; and the storage hole is formed through the storage plank.

3. The water tap as claimed in claim 2, wherein the storage frame is mounted on the tap stand opposite to the outlet section.

4. The water tap as claimed in claim 3, wherein the outlet section has two arms protruding from the tap stand, being parallel to each other and respectively having an inner surface facing each other; and the outfalls are respectively formed through the inner surfaces of the arms of the outlet section and communicating with the flowing channel of the tap stand, and each outfall has a L-shaped cross section.

5. The water tap as claimed in claim 4, wherein the storage plank has a curved edge;

the storage hole is semicircular and formed through the storage plank and depressed from the curved edge of the storage plank.

6. The water tap as claimed in claim 4, wherein the storage plank has a curved edge;

the storage hole is polygonal in shape and formed through the storage plank and depressed from the curved edge of the storage plank.

7. The water tap as claimed in claim 5, wherein the inlet of the tap stand comprises multiple circular holes.

8. The water tap as claimed in claim 1, wherein the storage frame is mounted on the tap stand opposite to the outlet section.

9. The water tap as claimed in claim 1, wherein the outlet section has two arms protruding from the tap stand and parallel to each other and respectively having an inner surface facing each other; and the outfalls are respectively formed through the inner surfaces of the arms of the outlet section and communicating with the flowing channel of the tap stand, and each outfall has a L-shaped cross section.

10. The water tap as claimed in claim 1, wherein the storage plank has a curved edge;

the storage hole is semicircular and formed through the storage plank and depressed from the curved edge of the storage plank.

11. The water tap as claimed in claim 1, wherein the storage plank has a curved edge;

the storage hole is polygonal in shape and formed through the storage plank and depressed from the curved edge of the storage plank.

12. The water tap as claimed in claim 1, wherein the inlet of the tap stand comprises multiple circular holes.

13. The water tap as claimed in claim 1, wherein the outlet section has a connecting outfall communicating with the flowing channel and the outfalls; and the connecting outfall and the outfalls jointly present a V-shaped cross section.

14. The water tap as claimed in claim 3, wherein the outlet section has a connecting outfall communicating with the flowing channel and the outfalls; and the connecting outfall and the outfalls jointly present a V-shaped cross section.

* * * * *